US007270241B2

(12) United States Patent
Nobili

(10) Patent No.: US 7,270,241 B2
(45) Date of Patent: Sep. 18, 2007

(54) DEVICE FOR SUPPORTING AND RETAINING OBJECTS TO BE DISPLAYED AND ASSOCIATED DISPLAY SYSTEM

(75) Inventor: Renato Nobili, Correzzana (IT)

(73) Assignee: Sarno S.p.A., Barzano (Lecco) (IT)

( * ) Notice: Subject to any disclaimer, the term of this patent is extended or adjusted under 35 U.S.C. 154(b) by 45 days.

(21) Appl. No.: 11/089,119

(22) Filed: Mar. 23, 2005

(65) Prior Publication Data

US 2005/0211649 A1 Sep. 29, 2005

(30) Foreign Application Priority Data

Mar. 29, 2004 (IT) ..... MI2004A0607

(51) Int. Cl.
*A47F 7/02* (2006.01)

(52) U.S. Cl. ..... 211/85.1

(58) Field of Classification Search ..... 211/85.1, 211/8, 13.1, 4; 248/902; 206/5, 6
See application file for complete search history.

(56) References Cited

U.S. PATENT DOCUMENTS 763,461 A * 6/1904 Burton et al. ..... 211/8
1,714,087 A * 5/1929 Goldhardt ..... 211/8
3,958,694 A 5/1976 Pritz et al.
4,596,334 A * 6/1986 Daulton ..... 211/64
5,257,703 A 11/1993 Ascik et al.
6,182,840 B1 2/2001 Tegel
7,047,771 B2 * 5/2006 Tanos ..... 70/16

FOREIGN PATENT DOCUMENTS

FR 2830732 A 4/2003

* cited by examiner

*Primary Examiner*—Sarah Purol
(74) *Attorney, Agent, or Firm*—Seyfarth Shaw LLP

(57) ABSTRACT

A device for housing and retaining objects to be displayed, comprising a fixed upright housing at least one rotating element in the form of a circle segment, the circumference of which consists of an annular edge extending over a center angle such as to define an empty arc with a suitable center angle, the outer surface of the annular edge being provided with teeth extending over a suitable angular section and able to engage with means for transmission of the movement to the said rotating element, so as to cause a rotation of the latter able to bring the free end of the annular edge from a first angular position at a distance from the fixed upright into a second angular position in contact with the said fixed upright and vice versa.

40 Claims, 2 Drawing Sheets

Fig.1
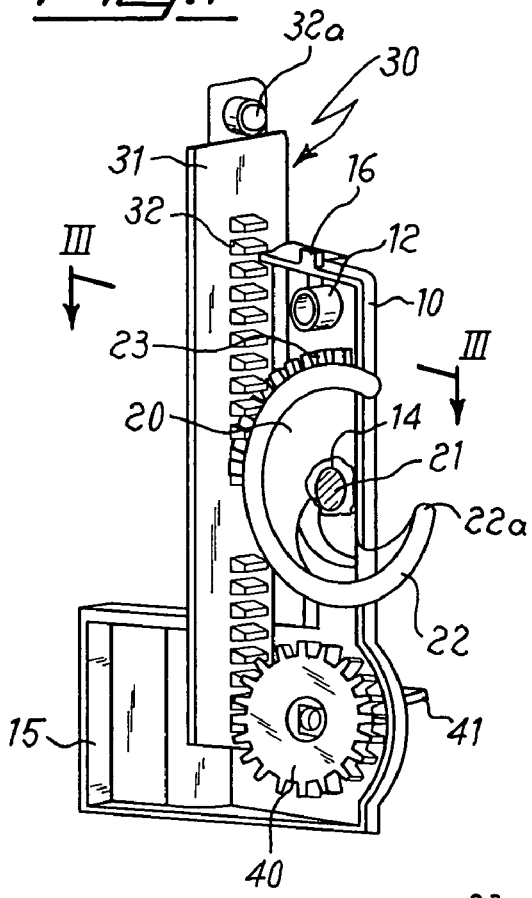
Fig.2
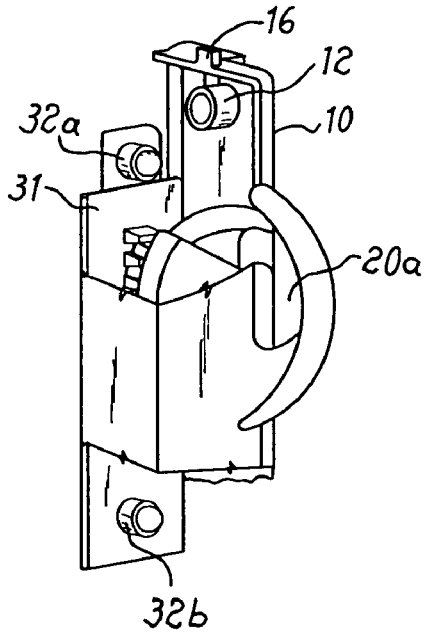
Fig.5
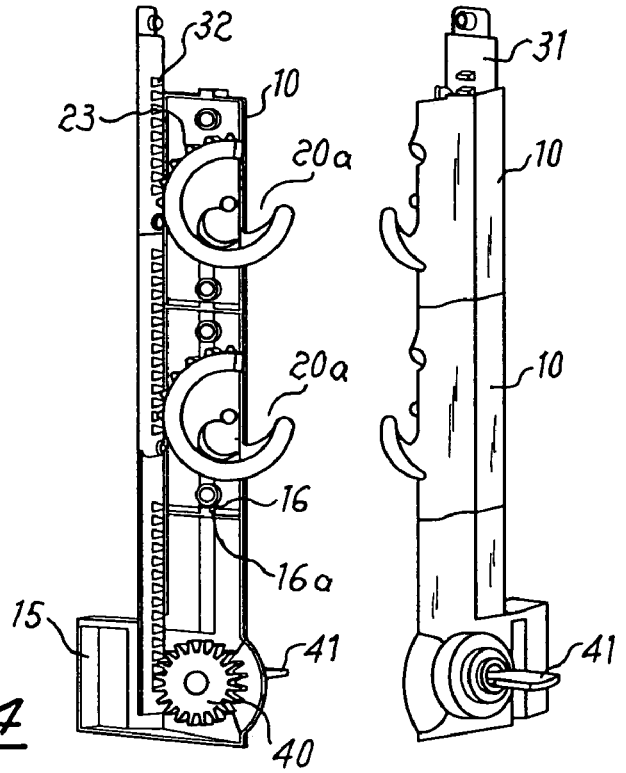
Fig.3
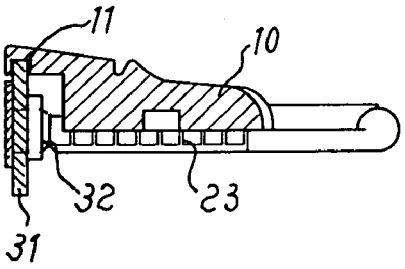
Fig.4

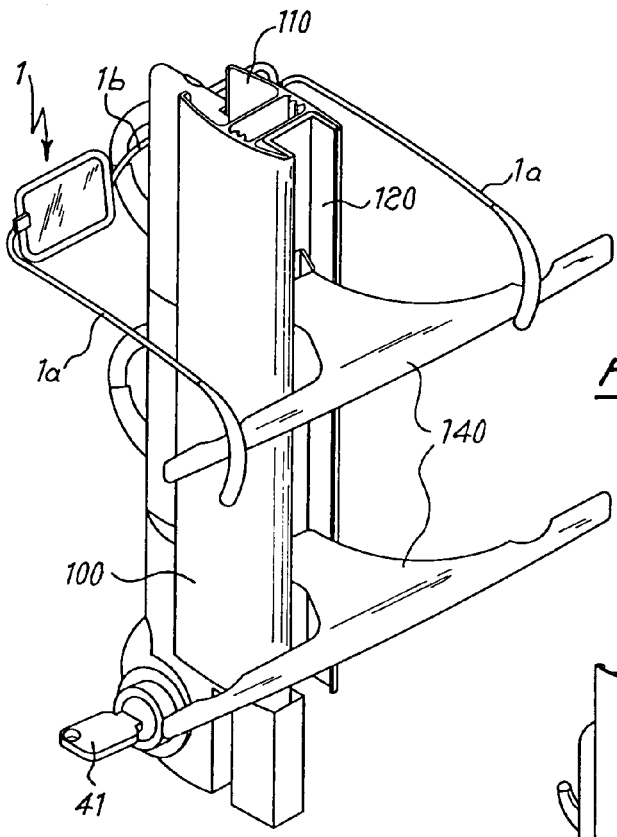
Fig.6
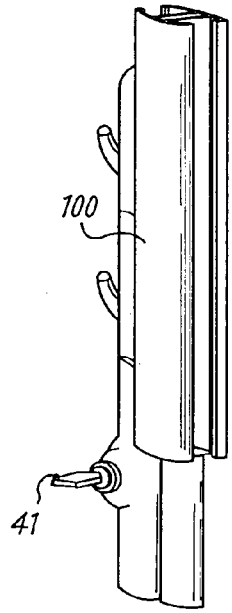
Fig.7
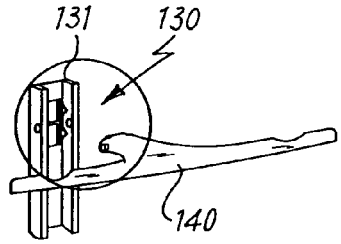
Fig.9
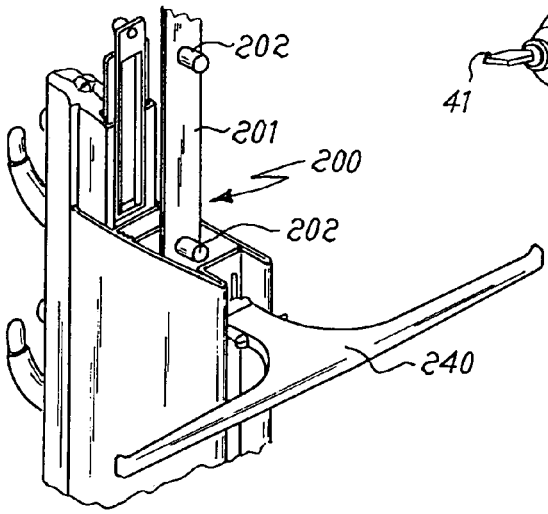
Fig.8
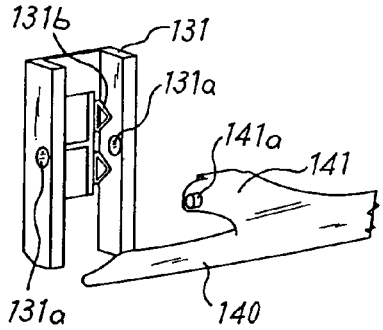

DEVICE FOR SUPPORTING AND RETAINING OBJECTS TO BE DISPLAYED AND ASSOCIATED DISPLAY SYSTEM

The present invention relates to a device for housing and retaining objects to be displayed.

It is known in the technical sector relating to the display of various objects for sale that there exists the need for the said objects to be made very visible to the potential purchaser so as to allow easy selection of the prechosen object, but at the same time ensure secure conditions for the objects on display, which must be constrained so as to prevent unauthorised removal thereof.

An example of this need consists in the display systems for spectacles which require substantially vertical racks on which the various models may be displayed.

It is also known that, in order to achieve this, provision has been made for display systems equipped with devices for performing closing/opening by means of movable parts in order to determine the formation of seats in which the bridge-piece of the spectacles may be rested so that it remains locked inside said seat. Although performing their function, these devices are, however, complicated and costly to manufacture and are not of a very modular nature such that they may adapted to the size of the display system actually required depending on the specific application and/or the number of objects to be displayed.

The technical problem which is posed, therefore, is that of providing a modular device able to form a seat which can be opened and closed for retaining objects on display such as, for example, spectacles and the like. In connection with this problem it is also required that this device should have small dimensions, be easy and inexpensive to produce and assemble and allow optimum viewing of the object by the potential purchaser.

These results are obtained according to the present invention by a device for housing and retaining objects to be displayed, comprising a fixed upright housing at least one rotating element in the form of a circle segment, the circumference of which consists of an annular edge extending over a centre angle such as to define an empty arc with a suitable centre angle, the outer surface of the annular edge being provided with teeth extending over a suitable angular section and able to engage with means for transmission of the movement to the said rotating element, so as to cause a rotation of the latter able to bring the free end of the annular edge from a first angular position at a distance from the fixed upright into a second angular position in contact with said fixed upright and vice versa.

Further details may be obtained from the following description of a non-limiting example of embodiment of the present invention provided with reference to the accompanying drawings in which:

FIG. 1 shows a schematic perspective view of the modular device according to the present invention with the seat for housing the object open;

FIG. 2 shows a partial view of the device according to FIG. 1 with the seat for housing the object closed;

FIG. 3 shows a partial schematic cross-section along the plane indicated by III-III in FIG. 2;

FIG. 4 shows a schematic perspective view, similar to that of FIG. 1, of a multiple device according to the present invention;

FIG. 5 shows a schematic perspective view of the cover for closing the visible side of the multiple device according to FIG. 4;

FIG. 6 shows a schematic perspective view, from the rear, of a display system for spectacles according to the present invention;

FIG. 7 shows a partially exploded, schematic, perspective view of the rear side of the display system according to FIG. 6;

FIG. 8 shows a partially exploded, schematic, perspective view of the detail of the means for supporting the arms of the spectacles; and FIG. 9 shows a schematic perspective view of a further example of embodiment of the display system with illumination means.

As illustrated in FIG. 1, the modular device for housing and retaining objects on display according to the present invention comprises a fixed upright 10 having, formed thereon, a rear longitudinal seat 11 and transverse bushes 12 suitable for engagement with corresponding pins of a closing cover 13. The fixed upright 10 also has, formed therein, a hole 14 for housing the shaft 21 of a rotating element 20 in the form of a circle segment.

Said circle segment is solid over about a quarter of the centre angle and empty over the remaining part; moreover, the circumference of the rotating element 20 consists of an annular element 22 extending over about three quarters of the centre angle so as to define an empty arc of about one quarter of the centre angle.

The outer side of the annular edge 22 is provided with teeth 23 extending over a suitable angular section and able to engage with the means 30 for transmission of the movement to the said rotating element.

Said transmission means 30 consist of a bar 31 inserted inside the longitudinal seat 11 of the upright 10 and movable translatably with respect thereto; said bar 31 has a rack 32 directed towards the teeth 23 of the rotating element 20 with which it is able to mesh by means of actuation of the latter.

The rack 31 is able to mesh also with a pinion 40 pivotably mounted on an associated base 15 integral with the upright 10, said pinion 40 constituting the actuating means of the device.

As shown in FIG. 4, the pinion 40 is integral with operating means shown by way of example in the figure as a key 41 operating a lock, rotation of which causes rotation of the pinion 40.

According to alternative embodiments, it is envisaged that said pinion may be able to be actuated by means of the electric type such, for example, small motors and the like which may, if necessary, be operated by means of remote control.

The modular device according to the invention (FIG. 4) envisages, moreover, fastening means 16 integral with the upright 10 and able to be coupled with corresponding projections 16*a* of an adjacent upright so as to allow extension, in the longitudinal direction, of the device so as to form a multiple display system as shown in FIG. 6.

In order to ensure the continuity of transmission of the movement to the various rotating elements, each bar 30 with rack 31 has in turn (FIG. 2) at least one pin 32*a* projecting in the transverse direction and at least one seat 32*b* which are respectively able to be coupled with a corresponding seat 32*b*/pin 32 of a bar 30 adjacent in the longitudinal direction.

Once a plurality of modules have thus been assembled in the longitudinal direction, it will be possible to provide a multiple-seat device 22*a* shown in FIG. 4, where the rotating elements 20 for opening/closing the object-carrying seats 20*a* are operated by a single pinion 40 arranged on the base 15 usually positioned so that it can be easily reached by authorised personnel.

FIG. 6 shows a display system, in particular for spectacles, inside which a device according to the present invention is arranged; in greater detail said display system comprises an upright 100 formed by a substantially H-shaped section able to form a front longitudinal housing 110 for containing a modular device according to the present invention and a rear longitudinal housing 120 able to house elements 130 for supporting a second part 1*a* of the object 1 to be displayed.

In the example shown, where the object to be displayed is a pair of spectacles 1, this part is formed by the arms 1*a* of the said spectacles.

As shown in detail in FIGS. 7 and 8, said rear support element consists of a longitudinal rail 131 which can be inserted inside corresponding seats of the rear housing 120; said rail has holes 131*a* arranged at predefined distances in the longitudinal direction and able to receive corresponding pins 141*a* projecting in the transverse direction from a flange 141 of the element 140 for supporting the arms 1*a* of the spectacles, so that the support may rotate, varying its inclination with respect to the person viewing it.

The rail 131 is also provided with two reliefs 131*b* arranged on opposite sides in the longitudinal direction with respect to the flange 141 of the support 140 so as to form respective top and bottom stops for rotation of the said support.

The operating principle of the display system is as follows:

- an upright 100 of suitable length for the required displaying need is prepared;
- numerous modules of the housing and retaining device are inserted inside the front housing 110 in the longitudinal direction and are fastened together via the means 16,16*a* and 22*a*,22*b* of the respective uprights 10 and bars 20;
- the operating device 40 is arranged at the base of the upright 100;
- a rear support 140 for the arms of the spectacles is arranged opposite each front rotating element;
- the operating means 41 are operated so as to cause rotation of the pinion 40, translation of the bars 30 and rotation of the rotating elements 20 and therefore opening of the seat 20*a* housing the bridge-piece 1*b* of the spectacles 1;
- the spectacles 1 are arranged with the bridge-piece 1*b* inside the respective seat 20*a* and arms 1*a* resting on the corresponding rear support 140;
- the operating means 41 are operated in the opposite direction so as to obtain closing of the seats 20*a;*
- the key 41 is extracted so as to prevent operation by non-authorised persons;
- the inclination of the rear support 140 is adjusted so as to produce different inclinations of the spectacles 1 with respect to the potential purchaser so that all the spectacles are oriented so that they may be viewed in the same manner whatever their distance from the base.

Although described in relation to objects which require advantageously the rear means 140 for adjusting the inclination of the spectacles, it is envisaged that the display system may comprise solely the front housing and retaining device if the particular form of the objects to be displayed should not require adjustment of their relative inclination.

FIG. 9 shows a further example of embodiment of the display system according to the present invention where illumination means 200 are inserted inside the section 100 in the longitudinal direction; said means have a insulated longitudinal support 201 carrying the leads for supplying power to the LEDs arranged on the support at relative distances such as to be arranged opposite each support 240 of the arms.

Said support 240 is in this case made of transparent material able to act as a light guide for diffusing the light towards the outside.

It is therefore clear how the device and the display system according to invention allow the display of objects such as spectacles and the like in an optimum manner for viewing by the potential purchaser and how the display system is made secure against unauthorised removal of the objects, by means of the rotating means for opening/closing the front seat which houses a part of the object to be displayed.

The invention claimed is:

1. A device for housing and retaining objects to be displayed, comprising a fixed upright housing at least one rotating element in the form of a circle segment, the circumference of which consists of an annular edge extending over a center angle such as to define an empty arc with a suitable center angle, the outer surface of the annular edge being provided with teeth extending over a suitable angular section and able to engage with a means for transmission of the movement to the said rotating element, so as to cause a rotation of the latter able to bring the free end of the annular edge from a first angular position at a distance from the fixed upright into a second angular position in contact with said fixed upright and vice versa.

2. The device according to claim 1, wherein means for transmission of the movement consists of a bar provided with a rack able to engage with the teeth of the rotating element.

3. The device according to claim 2, wherein said bar extends parallel to the longitudinal axis of the device.

4. The device according to claim 2, wherein said bar has at least one pin projecting in a transverse direction and at least one seat which are respectively able to be coupled with a corresponding seat pin of an other bar adjacent in the longitudinal direction.

5. The device according to claim 1, wherein said device comprises means for actuating the movement transmission means.

6. The device according to claim 5, wherein said actuating means consists of a pinion pivotably mounted on said upright.

7. The device according to claim 5, wherein said actuating means is associated with operating means.

8. The device according to claim 7, wherein said operating means consists of a lock with key.

9. The device according to claim 7, wherein said operating means consists of an electric motor.

10. The device according to claim 9, wherein said electric motor can be operated remotely by means of a remote control or the like.

11. The device according to claim 1, wherein the upright has, formed therein, a rear longitudinal seat for housing said movement transmission means.

12. The device according to claim 1, wherein at least one transverse bush able to engage with a corresponding pin of a cover for closing the device is formed on the upright.

13. The device according to claim 1, wherein at least one hole for housing the shaft of said rotating element is formed on the upright.

14. The device according to claim 1, wherein said circle segment is solid over about a quarter of the center angle and empty over the remaining part.

15. The device according to claim 1, wherein said upright is provided with fastening means able to be coupled with corresponding projections of the upright adjacent in the longitudinal direction.

16. A display system, comprising a device for housing and retaining objects to be displayed, comprising a fixed upright housing, at least one rotating element in the form of a circle segment, the circumference of which consists of an annular edge extending over a center angle such as to define an empty arc with a suitable center angle, the outer surface of the annular edge being provided with teeth extending over a suitable angular section and able to engage with means for transmission of the movement to the said rotating element so as to produce a rotation of the latter able to bring the free end of the annular edge from a first angular position at a distance from the fixed upright into a second angular position in contact with said fixed upright and vice versa.

17. The display system according to claim 16, wherein said means for transmission of the movement consists of a bar provided with a rack able to engage with the teeth of the rotating element.

18. The display system according to claim 17, wherein said bar extends parallel to the longitudinal axis of the device.

19. The display system according to claim 17, wherein said bar has at least one pin projecting in the transverse direction and at least one seat which are respectively able to be coupled with a corresponding seat pin of a bar adjacent in the longitudinal direction.

20. The display system according to claim 16, comprising a means for actuating the said movement transmission means.

21. The display system according to claim 20, wherein said actuating means consists of a pinion pivotably mounted on said upright.

22. The display system according to claim 20, wherein said actuating means is associated with operating means.

23. The display system according to claim 22, wherein said operating means consists of a lock with key.

24. The display system according to claim 22, wherein said operating means consists of an electric motor.

25. The display system according to claim 24, wherein said electric motor can be operated remotely by means of remote control or the like.

26. The display system according to claim 16, wherein a rear longitudinal seat for housing said movement transmission means is formed on the upright.

27. The display system according to claim 16, wherein at least one transverse bush able to engage with a corresponding pin of a cover closing the device is formed on the upright.

28. The display system according to claim 16, wherein at least one hole for housing the shaft of said rotating element is formed on the upright.

29. The display system according to claim 16, wherein said circle segment is solid over about one quarter of the center angle and empty over the remaining part of the circle segment.

30. The display system according to claim 16, wherein said upright is a first upright and is provided with fastening means able to be coupled with corresponding projections of an a second upright adjacent to the first upright in the longitudinal direction.

31. The display system according to claim 16, comprising an upright formed by a substantially H-shaped section able to form a front longitudinal housing for containing a modular device for housing and retaining objects to be displayed and a rear longitudinal housing.

32. The display system according to claim 31, wherein said rear longitudinal housing is able to house elements supporting a second part of the object to be displayed.

33. The display system according to claim 32, wherein said rear support elements comprise a longitudinal rail which can be inserted inside corresponding seats of the rear housing.

34. The display system according to claim 33, wherein said rail has holes which are arranged at predefined distances in the longitudinal direction and are able to receive corresponding pins projecting in the transverse direction from an extension of an element for supporting the second part of the object to be displayed.

35. The display system according to claim 31, wherein the said track is also provided with at least two reliefs arranged on opposite sides in a longitudinal direction with respect to the flange of the support in order to form respective top and bottom stops for rotation of the said support.

36. The display system according to claim 31, further comprising an illumination means inserted inside the H-shaped section in the longitudinal direction.

37. The display system according to claim 36, wherein said illumination means has an insulated longitudinal support carrying leads for supplying power to the illumination means.

38. The display system according to claim 37, wherein said illumination means includes LEDs arranged on the support at relative distances such as to be positioned opposite each support for the second part of the object.

39. The display system according to claim 38, wherein said support for the second part of the object is made of transparent material.

40. The display system according to claim 16, wherein said object to be displayed is a pair of spectacles comprising a bridge-piece and arms.

* * * * *